US005095251A

United States Patent [19]

Cheng

[11] Patent Number: 5,095,251

[45] Date of Patent: Mar. 10, 1992

[54] LOW VOLTAGE DC LIGHT APPARATUS FOR A NEON LAMP

[76] Inventor: Kun-Cheng Cheng, No. 34, Lane 89, Chung-Hua Rd., Da-She Hsiang, Kaoshiung, Taiwan

[21] Appl. No.: 616,062

[22] Filed: Nov. 20, 1990

[51] Int. Cl.[5] ..... H05B 37/00

[52] U.S. Cl. ..... 315/171; 315/174; 315/225; 315/299

[58] Field of Search ..... 315/160, 171, 172, 174, 315/175, 176, 225, 291, 299, 362

[56] References Cited

U.S. PATENT DOCUMENTS 4,087,722 5/1978 Hancock ..... 315/225 X 4,468,592 8/1984 Ogura et al. ..... 315/225 X 4,749,914 6/1988 Feher et al. ..... 315/174 X

*Primary Examiner*—Robert J. Pascal

*Attorney, Agent, or Firm*—Oblon, Spivak, McClelland, Maier & Neustadt

[57] ABSTRACT

A lighting apparatus for a neon lamp includes a direct current power supply with a relatively low voltage output. The direct current power supply actuates a pulse oscillator to produce a narrow pulse voltage train output. The narrow pulse voltage train output is amplified and is supplemented by the signal output of a glow control cirucit to drive the neon lamp into operation. The signal output of the glow control cirucit can be a pulsating voltage signal or a constant voltage signal to correspondingly cause the neon lamp to blink or glow constantly.

1 Claim, 4 Drawing Sheets

LOW VOLTAGE DC LIGHT APPARATUS FOR A NEON LAMP

BACKGROUND OF THE INVENTION

1. Field Of The Invention

The invention relates to a lighting apparatus for a neon lamp, more particularly to a lighting apparatus which uses direct current to operate the neon lamp.

2. Description Of The Related Art

Neon lamps usually consist of a pair of electrodes sealed within a glass bulb containing neon at a low pressure. The electrodes emit electrons whenever a sufficient voltage difference is applied across them. With a sufficiently high voltage difference between the electrodes, the velocity of electron flow is high enough to ionize the neon gas nearest the negative electrode (cathode) of the lamp, thereby causing the neon gas to flow. Conventional lighting apparatuses for neon lamps use a high voltage alternating current power source to operate the neon lamp. Both electrodes of the lamp alternately act as cathodes, causing both electrodes to glow alternately. At usual frequencies, the alternations occur so rapidly that both electrodes appear to blow constantly.

SUMMARY OF THE INVENTION

The objective of the present invention is to provide a lighting apparatus for a neon lamp, said lighting apparatus using a low voltage direct current power supply to operate the neon lamp.

Accordingly, the preferred embodiment of a lighting apparatus of the present invention comprises direct current power supply means having a relatively low voltage output; pulse oscillator means actuated by the direct current power supply means to output a narrow pulse voltage train output; and amplifying means to amplify the narrow pulse voltage train output. A glow control means has a signal output which supplements the output of the amplifying means to drive the neon lamp into operation. The signal output of the glow control means can be a pulsating voltage signal output or a constant voltage signal output. The neon lamp has a blinking light output when the signal output of the glow control means is pulsating. The neon lamp has a constant light output when the signal output of the glow control means is constant. The relatively low voltage output of the direct current power supply means ensures lower power consumption, thereby making the use of the preferred embodiment more economical.

BRIEF DESCRIPTION OF THE DRAWINGS

Other features and advantages of this invention will become apparent in the following detailed description of the preferred embodiment with reference to the accompanying drawings, of which.

DETAILED DESCRIPTION OF THE PREFERRED EMBODIMENT

Figure 1:
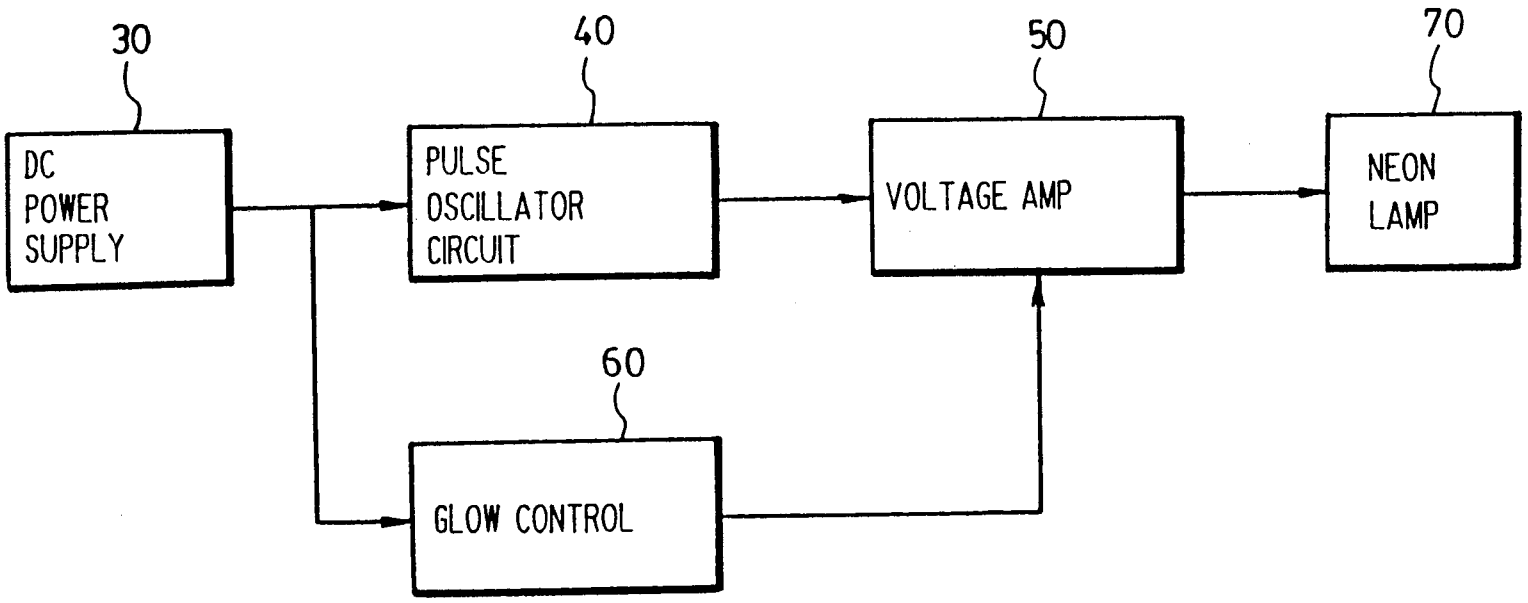
FIG. 1 is a schematic block diagram of the preferred embodiment of a lighting apparatus according to the present invention.

Referring to the schematic block diagram shown in FIG. 1, the preferred embodiment of a lighting apparatus according to the present invention is shown to comprise direct current power supply means 30, a pulse oscillator circuit 40, voltage amplifying means 50, and glow control means 60. The preferred embodiment is used to actuate a neon lamp 70.

Figure 2:
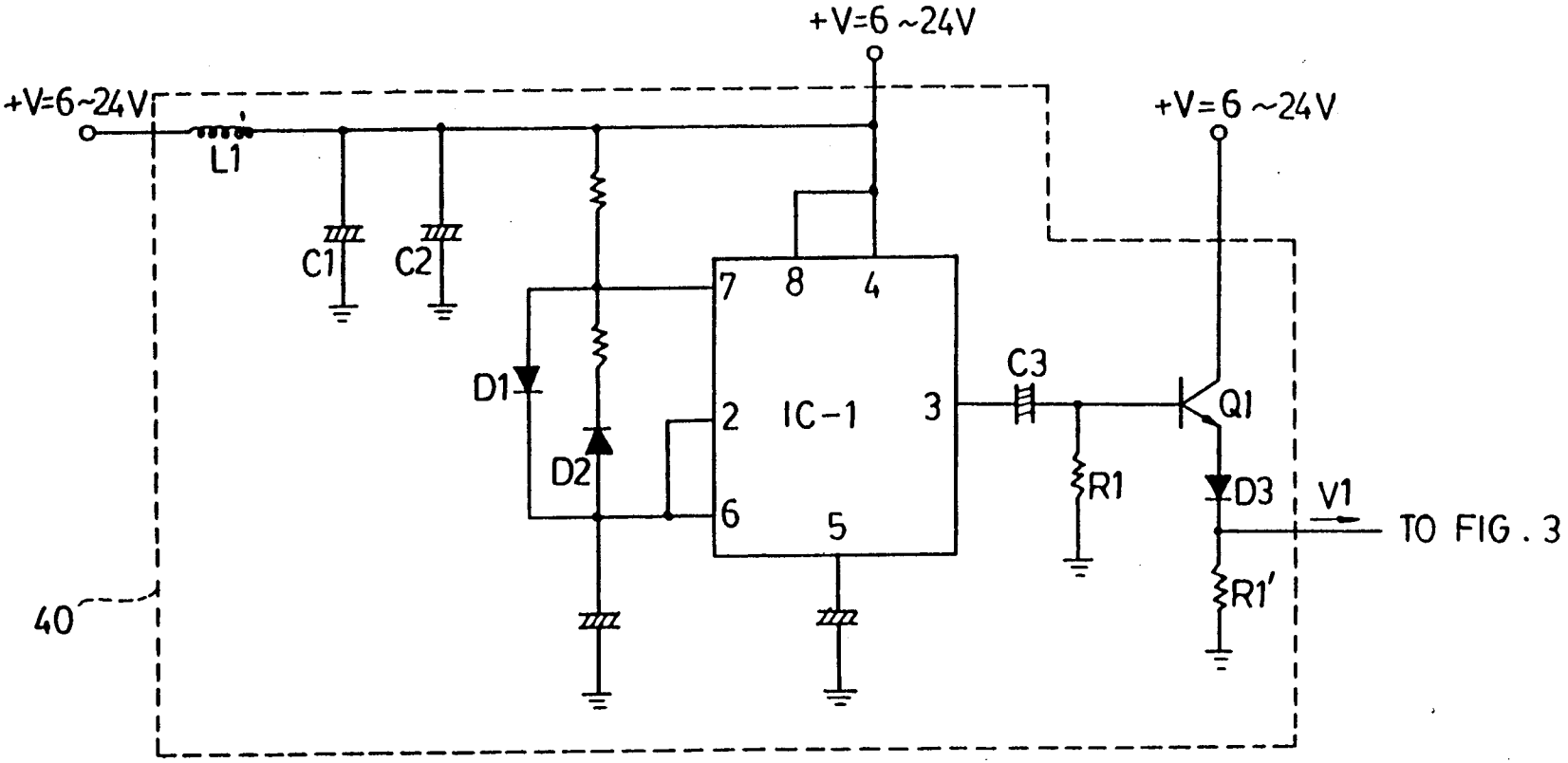
FIG. 2 is a schematic circuit diagram of a pulse oscillator circuit of the lighting apparatus of the present invention.

A schematic circuit diagram of the pulse oscillator circuit 40 is shown in FIG. 2. The direct current power supply means 30 (indicated by +V) provides a 6–24 volt supply input to the pulse oscillator circuit 40. The voltage output of the direct current power supply means 30 is filtered by an inductor L1 and capacitors C1 and C2. The pulse oscillator circuit 40 includes an integrated circuit IC1 (preferably LM 555) configured as an astable multivibrator. Diodes D1 and D2 are used to set the periods of the ON and OFF states of the pulse output at pin 3 of the integrated circuit IC1. The pulse output of IC1 charges a charging network consisting of a capacitor C3 and a resistor R1. The resistor R1 is electrically connected to the base terminal of a transistor Q1. The collector terminal of the transistor Q1 is connected to the direct current power supply means 30 while the emitter terminal of the transistor Q1 is connected to the anode of a diode D3. The output V1 of the pulse oscillator circuit 40 is a narrow pulse train taken across a resistor R1' connected to the cathode of the diode D3.

Figure 3:
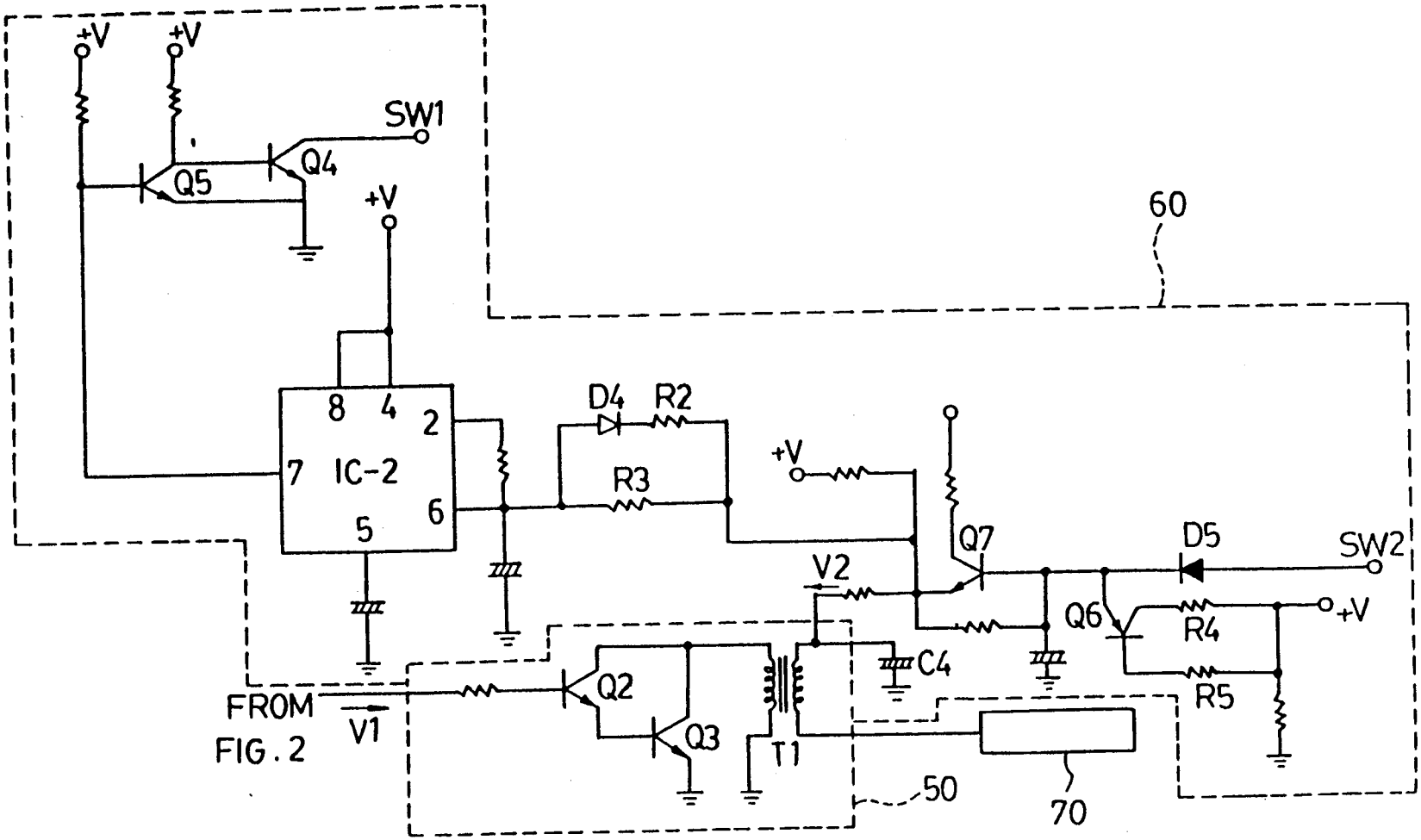
FIG. 3 is a schematic circuit diagram of a voltage amplifying means and a glow control means of the lighting apparatus of the present invention.

Referring to FIG. 3, the output V1 of the pulse oscillator circuit 40 serves as input to a Darlington transistor pair Q2 and Q3 of the voltage amplifying means 50. The voltage output of the Darlington transistor pair Q2 and Q3 is provided across the primary winding of a set-up transformer T1 is. One end of the secondary winding of the step-up transformer T1 is connected to an electrode of the neon lamp 70. This permits the voltage amplifying means 50 to actuate the neon lamp 70.

The glow control means 60 supplements the voltage output of the voltage amplifying means 50 and has a signal output V2 which charges a capacitor C4. The other end of the secondary winding of the step-up transformer T1 is connected to the capacitor C4, thereby allowing the signal output V2 to influence the voltage output of the voltage amplifying means 50. The glow control means 60 has two output modes selected by connecting either of two switches SW1 or SW2 to a direct current voltage source. When SW1 is selected, a portion of the glow control means 60 including transistors Q4 and Q5, integrated circuit IC2 (preferably GLC 555), diode D4 and resistors R2 and R3, yields a pulsating signal output V2. The neon lamp 70 is thus caused to blink. When SW2 is selected, another portion of the glow control means 60 including a diode D5, resistors R4 and R5, and transistors Q6 and Q7, yields a constant signal output V2 to operate the neon lamp 70 so as to continuously emit bright light. The lower starting voltage requirement of the preferred embodiment ensures lower power consumption.

Figure 4:
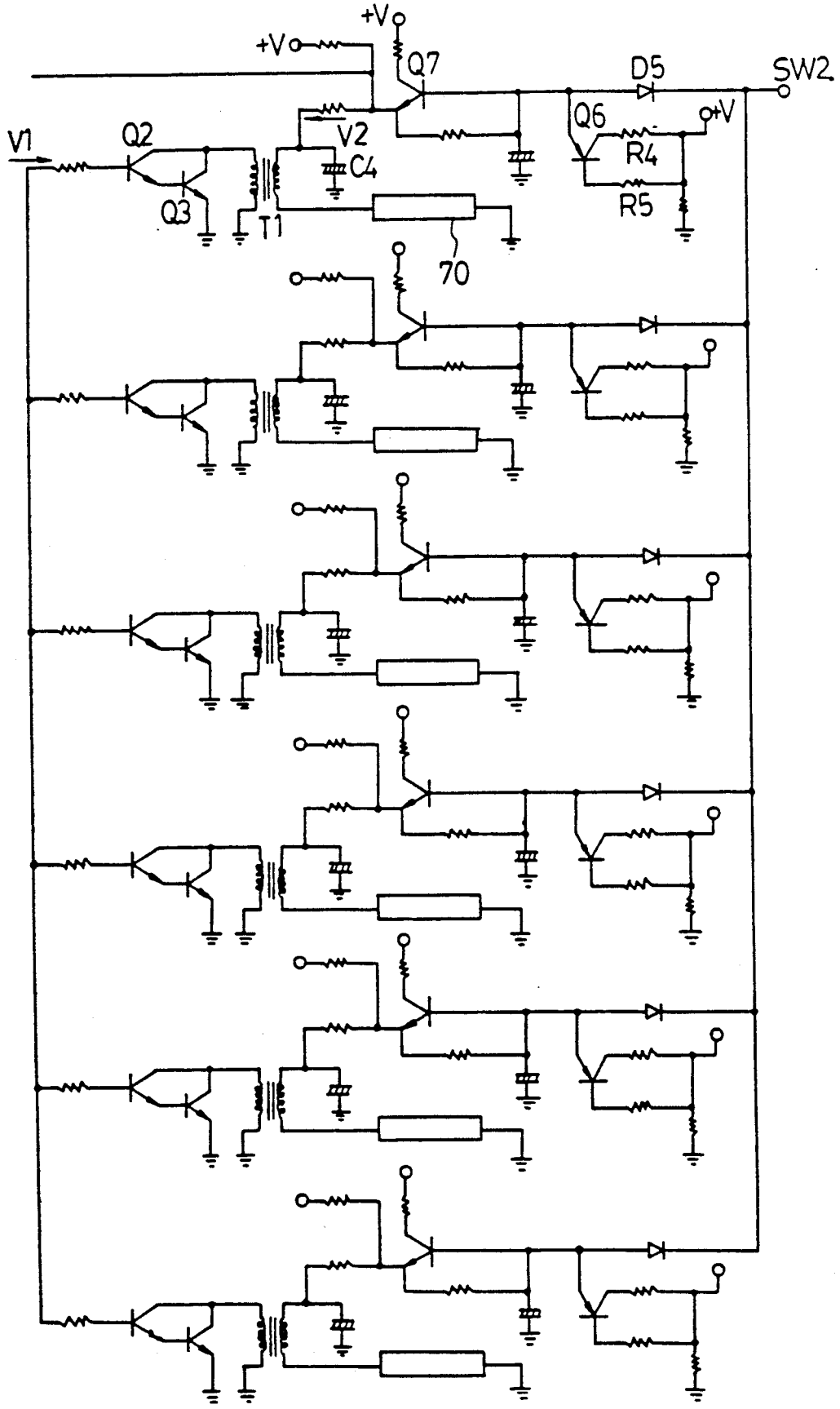
FIG. 4 is a modification of the schematic circuit diagram shown in FIG. 3 altered to permit actuation of a plurality of neon lamps.

Referring to FIG. 4, the output V1 of the pulse oscillator circuit 40 can serve as an input to a plurality of voltage amplifying means 50 and glow control means 60. This modification allows the preferred embodiment to simultaneously actuate a plurality of neon lamps 70.

While the present invention has been described in connection with what is considered the most practical and preferred embodiment, it is understood that this invention is not limited to the disclosed embodiment, but in intended to cover various arrangements included within the spirit and scope of the broadest interpretation so as to encompass all such modifications and equivalent arrangements.

I claim:

1. A lighting apparatus for a neon lamp, comprising:

direct current power supply means having an output voltage between 6 and 24 volts;

pulse oscillator means actuated by said direct current power supply means to output a narrow pulse voltage train output;

amplifying means to amplify said narrow pulse voltage train output; and glow control means having a signal output to supplement the amplified said narrow pulse voltage train output to drive said neon lamp into operation, said signal output being selectable between a pulsating voltage signal output and a constant voltage signal output;

said neon lamp having a blinking light output when said signal output of said glow control means is pulsating, said neon lamp having a constant light output when said signal output of said glow control means is constant.

* * * * *